US007152918B2

(12) United States Patent
Berkes

(10) Patent No.: US 7,152,918 B2
(45) Date of Patent: Dec. 26, 2006

(54) CHILD'S HIGH CHAIR THAT ROTATES AS A UNIT TO PRESENT A ROCKER OR A DESK

(76) Inventor: Thomas Berkes, 3025 W. Libby St., Phoenix, AZ (US) 85053

( * ) Notice: Subject to any disclaimer, the term of this patent is extended or adjusted under 35 U.S.C. 154(b) by 35 days.

(21) Appl. No.: 11/066,666

(22) Filed: Feb. 24, 2005

(65) Prior Publication Data

US 2006/0192414 A1 Aug. 31, 2006

(51) Int. Cl.
*A47C 13/00* (2006.01)

(52) U.S. Cl. ..... 297/3; 297/148; 297/271.6; 297/118

(58) Field of Classification Search ..... 297/1, 297/3, 153, 148, 152, 258.1, 271.5, 271.6, 297/130, 118
See application file for complete search history.

(56) References Cited

U.S. PATENT DOCUMENTS

| | | | | | |
|---|---|---|---|---|---|
| 618,067 | A | | 1/1899 | Diggs et al. | |
| 1,025,422 | A | | 5/1912 | Peters | |
| 1,326,415 | A | * | 12/1919 | Negus et al. | 297/1 |
| 1,729,941 | A | | 10/1929 | Hockings et al. | |
| D144,404 | S | * | 4/1946 | Mabry | D6/336 |
| 2,649,893 | A | * | 8/1953 | Spriggs | 297/130 X |
| 3,556,586 | A | * | 1/1971 | Beardmore | 297/3 |
| 3,879,083 | A | * | 4/1975 | Olsson | 297/1 |
| D248,516 | S | | 7/1978 | Johansson | |
| 4,783,118 | A | | 11/1988 | Ryan et al. | |
| 5,085,486 | A | * | 2/1992 | Johnson | 297/3 |
| 5,104,179 | A | * | 4/1992 | Jones | 297/3 |
| 5,415,454 | A | * | 5/1995 | Fu-Tsung | 297/130 X |
| 5,687,433 | A | * | 11/1997 | Garner et al. | 297/467 X |
| D409,007 | S | * | 5/1999 | Osterweil-Glaz et al. | D6/335 |

* cited by examiner

*Primary Examiner*—Anthony D. Barfield
(74) *Attorney, Agent, or Firm*—The Hill Law Firm PLC; Scott A. Hill

(57) ABSTRACT

A furniture unit for supporting the weight of a child in various selectable seated positions may be rotated as a unit about a horizontal axis to present any one of three available occupant supporting surfaces. The primary occupant supporting surface is a child's high chair, preferably having a fixed tray. When tipped backward from the high chair position, the unit presents a previously inaccessible chair which is convexed on its lower surface to permit it to sway back and forth as a rocker. Alternatively, the unit may be tipped forward from the high chair position to present a previously inaccessible desk chair, with desktop, that is uniquely spaced from the floor by the fixed tray. The unit will most preferably slide up to a dining table while in the high chair position such that the fixed tray may be positioned just over the surface of the dining table. Additionally, the unit may include a storage compartment located behind the back of the high chair, a crotch strap or post for the high chair, and modular game boards that are interchangeably mounted over the desktop.

19 Claims, 3 Drawing Sheets

CHILD'S HIGH CHAIR THAT ROTATES AS A UNIT TO PRESENT A ROCKER OR A DESK

BACKGROUND OF THE INVENTION

The present invention relates generally to a multi-purpose child's furniture unit that may be rotated to present different occupant supporting surfaces. The different presentations of the unit allow for a high chair, a rocker and a desk. Numerous similar furniture units are known to date back as early as the late $19^{th}$ century. One such early unit is the "convertible chair" that was invented by Riggs et al., U.S. Pat. No. 618,067, which included a flip-up tray and folding legs that allowed that unit to be oriented as a nursery chair or as a hobby-horse. That design was simplified by Negus et al., U.S. Pat. No. 1,326,415, to eliminate the need for folding legs, and then a very similar unit appeared in U.S. Pat. No. 1,729,941 to Hocking et al., which again used a flip-up tray.

Many years later, in U.S. Pat. No. 3,879,083 that issued in 1975, the Swedish inventor Olsson disclosed a convertible article of furniture that could be used as a play car in addition to a high chair and a rocker, but Olsson did not include any type of tray that could be used with the high chair. Ryan et al., U.S. Pat. No. 4,783,118, added casters and a removable tray to their convertible furniture, but did not include a high chair feature. Finally, Des. 248,516 to Johansson disclosed a convertible chair that could be used as a high chair, a child's rocker or a combined seat and table unit, but the high chair did not provide for any type of tray.

SUMMARY OF THE INVENTION

The present invention is a child's furniture unit for supporting the weight of a child in various selectable seated positions. The unit may be rotated about a horizontal axis to present any one of three available occupant supporting surfaces. The primary occupant supporting surface is a child's chair having a fixed tray. When tipped backward from the high chair position, the unit presents a previously inaccessible chair which is convexed on its lower surface to permit it to sway back and forth as a rocker. Alternatively, the unit may be tipped forward from the high chair position to present a previously inaccessible desktop and desk chair that are uniquely spaced from the floor by the fixed tray. No other prior art unit utilizes a tray as a desk leg.

The most preferred embodiment of the present invention will slide up to a dining table while in the high chair position such that the fixed tray may be positioned just over the surface of the dining table. Additionally, the present invention may include a storage compartment located behind the back of the high chair, a crotch strap or post for the high chair, and modular game boards that are interchangeably mounted over the desktop.

Figure 1:
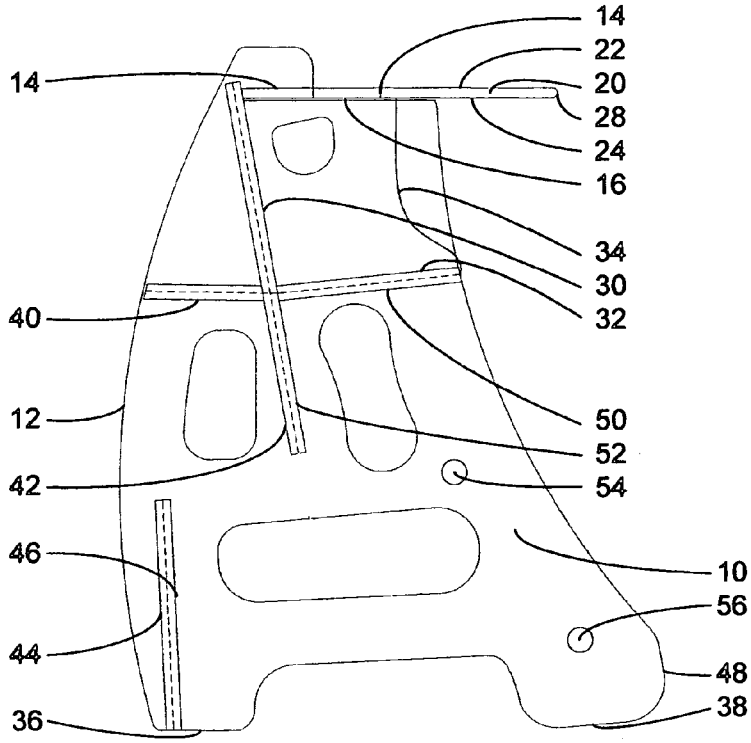
FIG. 1 is a cross section through line 2—2 of the child's chair of FIG. 2.

The following is the list of numerical callouts used in FIGS. 1–9:

10 Side frames
12 Convexed rear edge
14 Notch
16 Horizontal support ledge
20 Fixed tray
22 Tray top
24 Tray underside
26 Cutout
28 Tray front edge
30 High chair back
32 High chair bottom
34 Crotch strap
36 High chair rear legs
38 High chair front legs
40 Desk chair back
42 Desk chair bottom
44 Desktop
46 Desk underside
48 Desk front legs
50 Rocker back
52 Rocker bottom
54 Rocker hand grip
56 Support bar
60 Triangularly shaped void
70 Hinged storage panel
72 Latch
74 Storage compartment
80 Perimeter frame
82 Modular game board

DETAILED DESCRIPTION OF THE INVENTION

Figure 2:
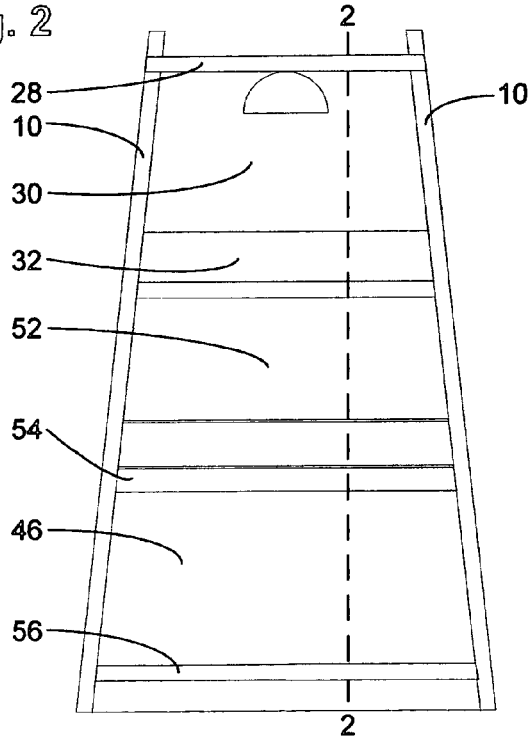
FIG. 2 is a perspective view of a child's chair of the present invention in the high chair position.

The most preferred embodiment of the present invention, shown in FIGS. 1 through 5, is a multi-purpose child's furniture unit that may be rotated to present different occupant supporting surfaces. The primary presentation of the unit, shown in FIGS. 1 and 2, is a high chair that has a fixed tray. This specification will describe the side frames 10, the fixed tray 20 and the various panels needed to make the present invention. The terms "bottom" and "back" are exclusively used to describe a seat bottom or a seat back, but because the unit may be rotated, the high chair bottom and the rocker back are the same panel, and the desk bottom and the rocker bottom are the same panel. The terms "front", "rear", "upper", "lower", "left" and "right" are all determined by an occupant using the unit in a high chair position, unless another position is clearly stated. The preferred embodiment's structure will be described first, followed by assembly, alternate embodiments and optional features. Preferred materials, shapes, methods of attachment and methods of assembly will be discussed, but these preferences are not intended to exclude suitable or functionally equivalent alternatives.

There are two side frames 10, a left and a right, that are substantially identical in overall shape and size. The most preferred material for making a side frame is a single sheet of 18 mm (¾ inch) Finland birch plywood because of its superior strength, resistance to warping, availability, beauty, and its relatively low cost. There are numerous other suitable wood materials that may be substituted, such as other plywoods, hardwoods, particle board, or MDF. If the market will justify the initial cost of tooling, the side frames 10, panels, and/or fixed tray 20 may be made by injection molding or otherwise forming plastic using a known method.

The side frames 10 each have a convexed rear edge 12. The amount of curvature in the convexed rear edge is a matter of preference, but a smooth curve that would be part of about a 1 meter radius circle is a good compromise between fun and safety. FIG. 1 shows a scaled 1.15 meter radius curve. The lower most part of a convexed rear edge of a side frame functions as a high chair rear leg 36. The upper most part of a convexed rear edge preferably curves into and extends over a notch 14 that is designed to accept the convexed rear edge of the fixed tray 20. The lower surface of a notch extends toward the front of a side frame to create a horizontal support ledge 16 that is designed to support an underside of the fixed tray. The vertical distance from a floor surface to the tray underside 24, substantially where the fixed tray meets with the horizontal support ledge, is preferably between 750 and 800 mm (millimeters), most preferably about 780 mm. The front edges of the side frames do not have many design constraints, so they may be shaped into any desired pattern that does not unreasonably compromise the ability of the side frames to support the intended uses of the unit. For stability, the high chair front legs 38 should be positioned well in front of the high chair rear legs, preferably at least 400 mm from the rear most part of a high chair rear leg to the front most part of a high chair front leg.

Figure 3:
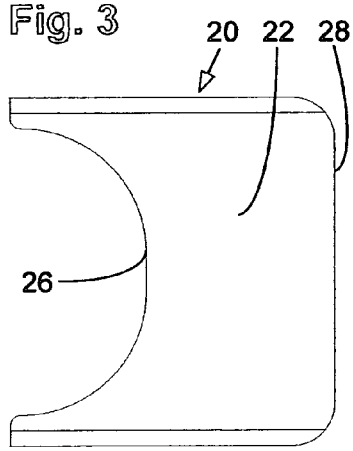
FIG. 3 is a plan view of the fixed tray of the child's chair of FIG. 2.

The fixed tray 20, best seen in FIG. 3, is a substantially rectangular planar panel that includes a cutout 26 for encompassing a child's torso. In the most preferred embodiment, the material used to make the fixed tray is similar to the material chosen for the side frames 10, but a rigid plastic would be an appropriate alternative. The width of the fixed tray, from left most edge to right most edge, is somewhat arbitrary, but custom dictates that it should be approximately 500 mm. The cutout should leave about 200 to 250 mm of depth for the child's torso, and at least 250 mm of width. The overall depth of the fixed tray will affect the height of the unit when it is in the desk position, but a useable tray top 22 should be at least 200 mm from the cutout to a tray front edge 28. To reduce the risk of injury, all exposed corners and edges should be rounded and smoothed.

When the unit is in the high chair position, FIGS. 1 and 2, a high chair back 30 and high chair bottom 32 are exposed to provide a child's seat structure that is slightly reclined. The back and bottom may be simple rectangular planar panels, as shown, or they may be contoured to better support a child's back and buttocks. A crotch strap 34 or post should be centrally mounted to the front edge of the high chair bottom and extend upwardly toward the fixed tray 20. The drawing figures use a crotch strap that is secured to the fixed tray, and the generous amount of slack shown is intended to allow the high chair to be pushed closely to a dining table when the high chair is not being used. The high chair rear legs 36 incorporate the convexed rear edge of the side frames 10. The high chair front legs 38 are built into the lower front edge of the side frames 10. It should be noted that a front view of the high chair, seen in FIG. 2, shows that the side frames have been tilted toward each other such that the lower part of the high chair is broader than the upper part of the high chair to give it more stability, but this feature is optional.

Figure 4:
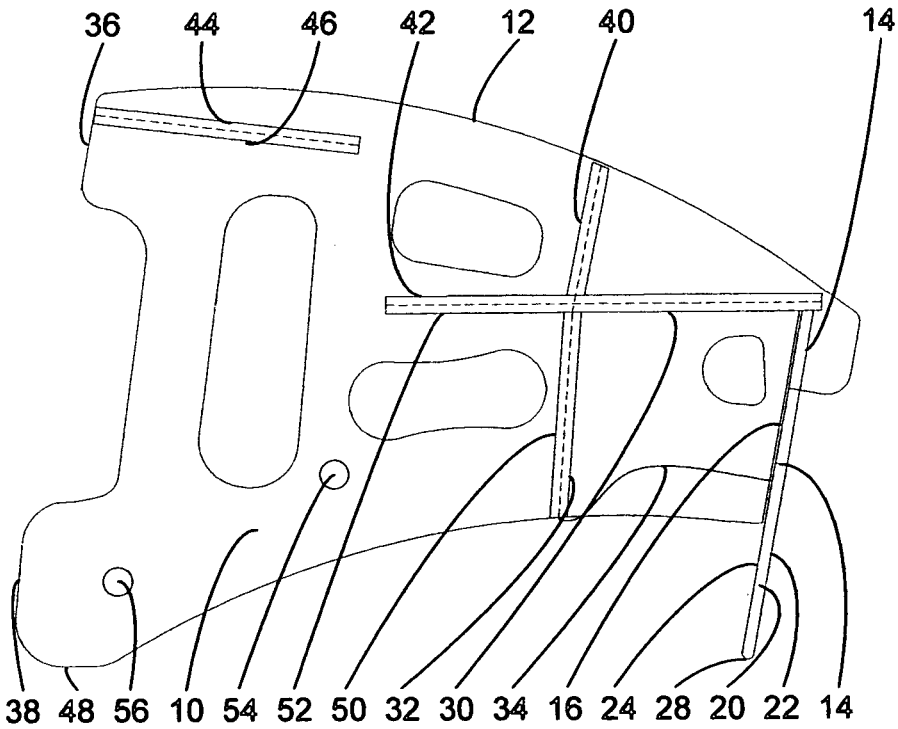
FIG. 4 is cross sectional view of the child's chair of FIG. 2 in the desk position.

When the unit is in the desk position, FIG. 4, a desk chair back 40 and desk chair bottom 42 are exposed to provide a child's seat structure that is again slightly reclined. Similar to the high chair, the desk chair back and bottom may be simple rectangular planar panels, as shown, or they may be contoured to better support a child's back and buttocks. The desk chair bottom shown in FIGS. 1,2,4 and 5 is an extension of the panel used to form the high chair back 30. The desk chair is low enough to the ground that there is no need for a crotch strap. The desk position uses the fixed tray 20 as rear legs such that the tray front edge 28 contacts the floor, and the fixed tray is substantially perpendicular to the floor surface. The desk front legs 48 are built into the lower front edge of the side frames 10, substantially utilizing the same structure as the high chair front legs 38.

The desktop 44 is mounted between the side frames 10 very near a lower portion of the convexed rear edges 12. The preferred desktop is a flat panel that is about 300 mm deep and about 500 mm wide. The desktop's edges can be mounted as close as about 10 mm from the convexed rear edges 12, leaving just enough clearance so that the desktop won't interfere with the function of the rocker. Also, the desktop should be mounted such that it is parallel to the floor surface when the unit is in the desk position, but in the alternative the desktop may slope downwardly slightly toward the desk chair bottom.

Figure 5:
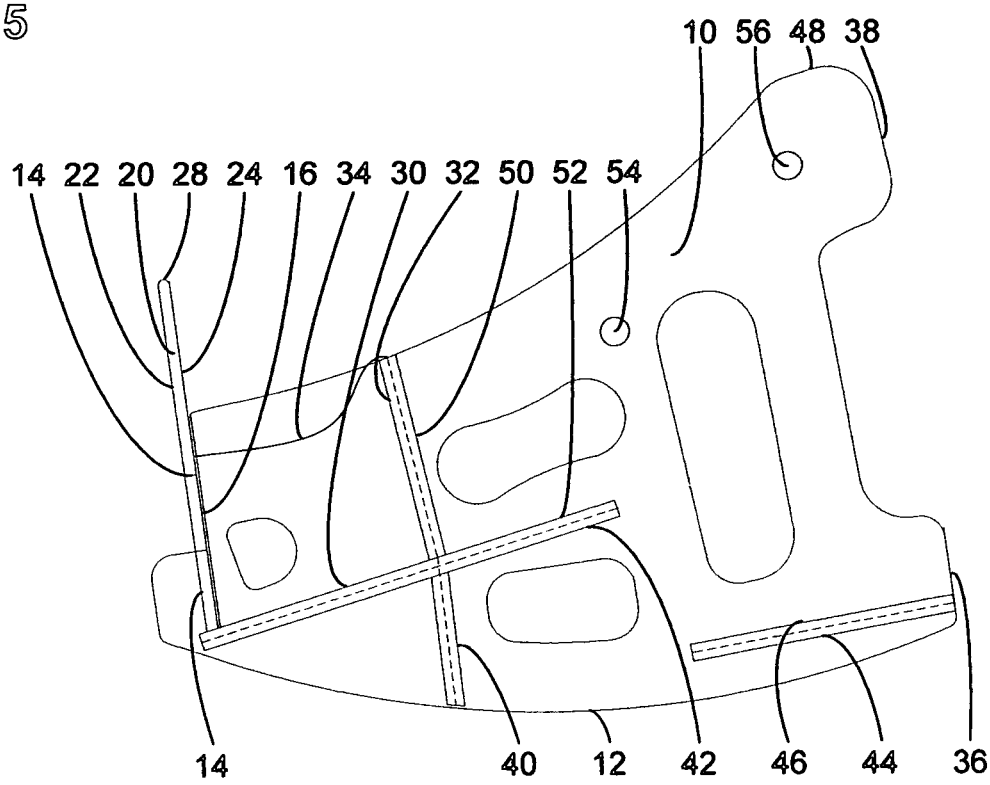
FIG. 5 is a cross sectional view of the child's chair of FIG. 2 in the rocker position.
Figure 6:
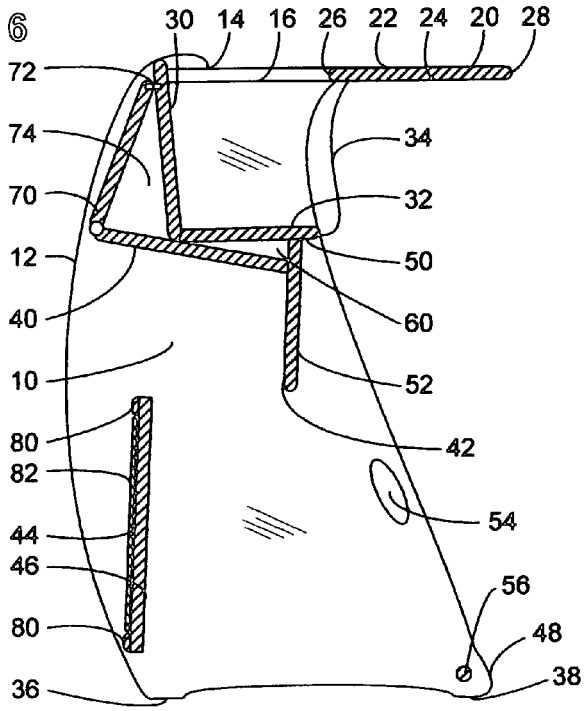
FIG. 6 is a cross sectional view of an alternative embodiment of the child's chair of the present invention in the high chair position.
Figure 7:
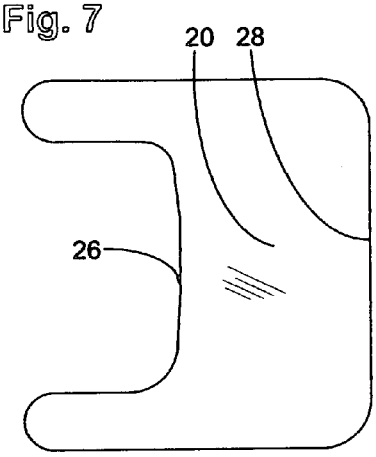
FIG. 7 is a plan view of the fixed tray of the child's chair of FIG. 6.

When the unit is in the rocker position, FIG. 5, a rocker back 50 and rocker bottom 52 are exposed to provide yet another child's seat structure. Once again, the rocker back and bottom may be simple rectangular planar panels, as shown, or they may be contoured. The rocker bottom of FIGS. 1,2,4 and 5 is the same panel as the desk chair bottom 42; and the rocker back is the same panel as the high chair bottom 32. Because an occupant using the rocker position will be leaning significantly forward to cause the unit to sway back and forth, it is acceptable for the rocker back to be at an acute angle with the rocker bottom. Also, an occupant will be using the desktop underside 46 as a foot rest, which has the added benefit of preventing the occupant from catching a foot under one of the traveling convexed rear edges 12 that supports the rocker position and allows the unit to sway back and forth. A rocker hand grip 54, such as a wooden pole, may be mounted between the side frames 10 as shown, or handholds may be cut into the front edges of the side frame so that an occupant can hang on to something for balance while swaying back and forth.

Assembly of the unit is fairly straightforward, and is accomplished by simply using fasteners, such as wood screws, to secure each panel between the side frames 10. Some weaker materials may require the addition of a support bar that extends between the high chair front legs 38 to stabilize the side frames 10. The addition of decorative moldings, hand holds, decorative cutouts and other finishing touches are a matter of preference, and it is expected that such features will be added and make the unit more aesthetically pleasing and lighter weight.

Figure 8:
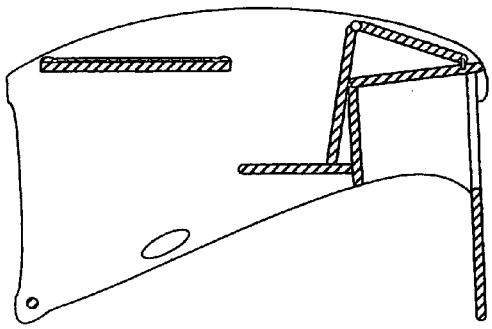
FIG. 8 is a cross sectional view of the child's chair of FIG. 6 in the desk position.
Figure 9:
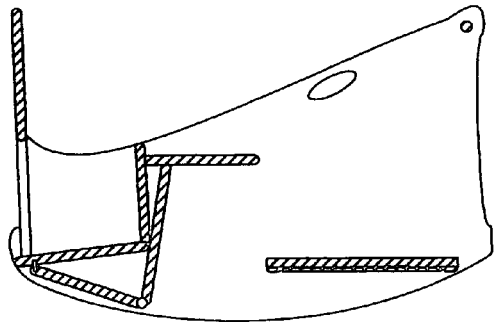
FIG. 9 is cross sectional view of the child's chair of FIG. 6 in the rocker position.

FIGS. 6–9 have been added to show how minor changes can necessitate an evaluation of the entire unit. The changes made to FIGS. 6–9 were to lengthen the fixed tray 20, best seen in FIG. 7, and offer an occupant a little more room in all of the various positions. To accomplish these minor changes, the single panel that was used to make the high chair back 30, desk chair bottom 42 and rocker bottom 52 was cut so that the high chair back was a separate panel. The desk chair bottom was significantly shifted toward the side frame's front edge, and a triangularly shaped void 60 was created to absorb the acuteness of the angle between the rocker back 50 and the rocker bottom. It should be noted that the rocker hand grip 54 is an alternative handhold that is cut into the front edges of the side frame, and a support bar 56 extends between the high chair front legs 38 to stabilize the side frames 10. Additionally, a hinged storage panel 70 was secured to the desk chair back 40, with a latch 72 that positions the hinged storage panel against the high chair back to create a storage compartment 74. FIGS. 8 and 9 are simply the child's high chair of FIG. 6 rotated into the desk position and the rocker position, respectively.

One final improvement was to mount a perimeter frame 80 to the desktop 44 such that various modular game boards 82 can be interchangeably supported on top of or just adjacent the desktop. The side frames 10 can act as part of the perimeter frame where the desktop intersects the side frames. A first example of a game board is a puzzle that is supported by the perimeter frame such that different shaped cutouts can be dropped through the game board, and then easily collected off the desktop once the game board is removed. A second example of a game board is a magnetic surface that is laid inside of the perimeter frame on top of the desktop. The magnetic surface can be used with magnetic toys, such as magnetic letters and numbers. A third example of a game board is a contoured surface that is suitable for attaching toy building blocks, such as Legos®. A finger slot may be added to either the modular game boards or the desktop to make it easier to grasp an edge of a game board that is to be removed from within the perimeter frame.

While a preferred form of the invention has been shown and described, it will be realized that alterations and modifications may be made thereto without departing from the scope of the following claims. For example: high chair feet extensions, such as a set of four 20 mm thick plastic spacers, can be included with a high chair unit so that the high chair's fixed tray can slide over the top of an exceptionally tall dining table; or the fixed tray may be equipped with heavy duty hardware that allows the tray to be lifted or swung away from a child that is in the high chair position, but the hardware is strong enough to secure the tray to the side frames when the unit is in the desk position.

What is claimed is:

1. A child's furniture unit having multiple occupant supporting surfaces comprising:

a high chair presentation having a fixed tray;

a rocker presentation that is convexed on its lower surface to permit it to sway back and forth;

a desk presentation having a desk chair and a desktop that are at least partially spaced from a floor surface by the fixed tray; and wherein rotation of the unit about a horizontal axis will present an occupant supporting surface of one of the presentations.

2. The child's furniture unit of claim 1 wherein, when the unit is in the high chair presentation, a distance from an underside of the fixed tray to the floor surface is at least 750 millimeters such that the fixed tray may be positioned just over a dining table.

3. The child's furniture unit of claim 2 further comprising high chair feet extensions that increase the distance from the underside of the fixed tray to the floor surface.

4. The child's furniture unit of claim 1 further comprising a storage compartment in the rear of the unit just behind the occupant supporting surface of the high chair presentation.

5. The child's furniture unit of claim 1 further comprising a crotch strap that extends from the occupant supporting surface of the high chair presentation to the fixed tray.

6. The child's furniture unit of claim 1 further comprising a crotch post that extends perpendicularly from the occupant supporting surface of the high chair presentation.

7. A child's furniture unit having multiple occupant supporting surfaces comprising:

a high chair presentation having a tray;

a rocker presentation that is convexed on its lower surface to permit it to sway back and forth;

a desk presentation having a desk chair and a desktop that are at least partially spaced from a floor surface by the tray;

a perimeter frame that is secured to the desktop; and wherein rotation of the unit about a horizontal axis will present an occupant supporting surface of one of the presentations.

8. The child's furniture unit of claim 7 further comprising a modular game board that interchangeably mounts over the desktop.

9. The child's furniture unit of claim 8 wherein the game board is a puzzle board having puzzle pieces.

10. The child's furniture unit of claim 9 wherein the puzzle board is spaced from the desktop such that each puzzle piece, when dropped into an appropriate cutout on the puzzle board, falls through the puzzle board onto the desktop where the puzzle pieces can easily be collected once the puzzle board is removed from the desktop.

11. The child's furniture unit of claim 8 wherein the game board is a magnetic surface that magnetically attracts magnetic toys.

12. The child's furniture unit of claim 8 wherein the game board is a contoured surface that is suitable for connecting and holding toy building blocks.

13. A child's furniture unit that may be rotated about a horizontal axis to present different occupant supporting surfaces comprising:

two side frames having convexed rear edges;

a high chair presentation having a high chair back and a high chair bottom;

a rocker presentation having a rocker back and a rocker bottom;

a desk presentation having a desk chair, including a desk chair back and a desk chair bottom, and a desktop; a high chair tray, wherein the high chair tray functions as a broad rear leg that partially supports the desk presentation wherein the construction of the unit is such that all of the backs and bottoms are substantially perpendicular to the side frames; and wherein a triangularly shaped void is formed using the high chair bottom, the desk chair back; the high chair tray and the rocker bottom such that the void absorbs undesired acute angles that would otherwise negatively affect the comfort of one of the presentations.

14. The child's furniture unit of claim 13 wherein the high chair tray is fixed with fasteners to horizontal support ledges that are substantially on the top of the side frames.

15. The child's furniture unit of claim 14 further comprising notches that extend from the upper most parts of the convexed rear edges of the side frames, the notches further fixing the high chair tray to the side frames.

16. The child's furniture unit of claim 13 wherein the high chair tray is pivotally fixed to the side frames, and wherein at least one latching device is provided for securing the high chair tray for use as the broad rear leg.

17. The child's furniture unit of claim 13 wherein, when the unit is in the high chair presentation, a distance from an underside of the high chair tray to the floor surface is at least 750 millimeters such that the high chair tray may be positioned just over a dining table.

18. The child's furniture unit of claim 13 further comprising a storage compartment in the rear of the unit, just behind the occupant supporting surface of the high chair presentation.

19. The child's furniture unit of claim 13 further comprising a modular game board that interchangeably mounts over the desktop.

* * * * *